US012215862B2

(12) United States Patent
Zeitler

(10) Patent No.: US 12,215,862 B2
(45) Date of Patent: Feb. 4, 2025

(54) TORCH CANISTER WITH FASTENED FLAME GUARD

(71) Applicant: Lamplight Farms Incorporated, Menomonee Falls, WI (US)

(72) Inventor: Lucas Henry Zeitler, Wauwatosa, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 453 days.

(21) Appl. No.: 17/368,457

(22) Filed: Jul. 6, 2021

(65) Prior Publication Data

US 2023/0010987 A1 Jan. 12, 2023

(51) Int. Cl.
*F23D 3/26* (2006.01)

(52) U.S. Cl.
CPC ..... *F23D 3/26* (2013.01); *F23D 2202/00* (2013.01)

(58) Field of Classification Search
CPC ..... F23D 3/26; F23D 2202/00
USPC ..... 431/320
See application file for complete search history.

(56) References Cited

U.S. PATENT DOCUMENTS 4,875,852 A * 10/1989 Ferren ..... F21S 13/00 431/324
5,205,730 A * 4/1993 Capdeville ..... F21L 17/00 362/159
9,551,486 B2 * 1/2017 Jackow ..... F23D 11/42
9,797,557 B2 * 10/2017 White ..... F21L 27/00
9,920,931 B2 * 3/2018 Hansen ..... F23D 3/26
10,371,379 B2 * 8/2019 Woodruff ..... F23D 3/26
10,837,634 B2 * 11/2020 Woodruff ..... F23D 3/32
10,842,146 B1 * 11/2020 Pannullo ..... F21V 37/002
10,887,581 B2 * 1/2021 Yücer ..... H04N 13/232
10,890,320 B1 * 1/2021 Seneca ..... B65D 1/02
11,428,343 B2 * 8/2022 Pannullo ..... F16K 31/20
11,503,822 B2 * 11/2022 Pannullo ..... F21V 37/0012
2001/0053504 A1 * 12/2001 Lu ..... F21S 13/10 431/33
2007/0015097 A1 * 1/2007 Baker ..... F23D 3/18 431/310
2007/0218413 A1 * 9/2007 Heng-Wei ..... F23D 3/26 431/320
2012/0258412 A1 * 10/2012 Jackow ..... F23D 14/60 431/254
2012/0276489 A1 * 11/2012 Fang ..... F23D 3/24 431/320
2013/0288186 A1 * 10/2013 White ..... F23D 14/28 431/344
2016/0327269 A1 * 11/2016 Hansen ..... F21V 37/0008
2017/0328557 A1 * 11/2017 Swann ..... F23D 3/18
2018/0137674 A1 * 5/2018 Yücer ..... G06T 7/564
2018/0139436 A1 * 5/2018 Yücer ..... H04N 13/106
2020/0408400 A1 * 12/2020 Seneca ..... B65D 1/00
2022/0015350 A1 * 1/2022 Pannullo ..... F23K 5/14
2022/0015351 A1 * 1/2022 Pannullo ..... F21V 37/0012
2022/0235877 A1 * 7/2022 Pannullo ..... F16K 31/465
2023/0010987 A1 * 1/2023 Zeitler ..... F23D 3/18
2023/0095561 A1 * 3/2023 Pannullo ..... F23K 5/14 431/344

* cited by examiner

*Primary Examiner* — Vivek K Shirsat
(74) *Attorney, Agent, or Firm* — GableGotwals; David G. Woodral

(57) ABSTRACT

A torch canister with a fuel reservoir has a neck extending from the top of the fuel reservoir defining a wick holder. The torch canister has a flame guard affixed to the neck.

15 Claims, 4 Drawing Sheets

TORCH CANISTER WITH FASTENED FLAME GUARD

FIELD OF THE INVENTION

This disclosure relates to outdoor torches in general and, more particularly, to liquid fuel burning torches.

BACKGROUND OF THE INVENTION

Outdoor torches, lawn torches, patio torches and the like frequently rely on liquid fuels for operation. The fuels may contain scents, repellents, and other additives. Some inconveniences of operation of such torches include the fueling or refueling operation, and placement of the fuel cannister within the torch for proper function.

Some fuel cannisters come prefilled and may be considered disposable or recyclable in that the fuel canister itself may be discarded after use rather than refilled from a separate container. Still, issues remain with respect to installation and operation of these fuel canisters. Some issues that may be faced include positioning the fuel container into a receptacle and attachment of a flame guard for proper operation. Additionally, even if the fuel cannister is already provided with a wick it may have need to be properly exposed and set for operation. This may involve contact with the fuel as the wick is extracted or exposed from its packing or shipping location. Extension of the wick may also mean it no longer has the ability to draw all of the fuel out of the container while burning properly.

What is needed is a system and device for addressing the above and related issues.

SUMMARY OF THE INVENTION

The invention of the present disclosure, in one aspect thereof, comprises a torch canister with a fuel reservoir having a side wall, a floor, and a top defining an interior volume for containing fuel. The torch canister has a neck extending from the top of the fuel reservoir and defining a wick holder. The canister has a flame guard affixed to the neck of the fuel reservoir and extending over the top and laterally beyond the side wall.

The flame guard may provide a cover that extends over the top and laterally beyond the side wall, and a collar centered in the cover that joins to the neck. The neck may define a threaded connection on an exterior thereof and an upright wall portion below the threaded connection that joins to the collar of the flame guard. The collar of the flame guard may be plastically deformed to grip the upright wall portion.

In some embodiments, the top of the fuel reservoir is frustoconical and elevates the neck above the fuel reservoir. The cover may be frustoconical and extend downward and away from the neck. The cover and the top of the fuel reservoir may be spaced apart.

Some canisters further comprise a wick retained in the wick holder and having a length that extends from a location above the wick holder sufficient to allow burning or liquid fuel from the wick to the floor of the fuel reservoir. A quantity of torch fuel may be provided within the fuel reservoir with a cap affixed to the threaded connection of the neck sealing the neck against fuel leaks without moving the wick.

In some embodiments, the top of the fuel reservoir and the floor of the fuel reservoir are both roll seamed to the side wall.

The invention of the present disclosure, in another aspect thereof, comprises a torch canister with a cylindrical fuel reservoir having a top extending upwardly therefrom to a neck, and a flame guard affixed to the neck and extending radially and downward therefrom beyond the fuel reservoir but spaced apart from the fuel reservoir top.

In some embodiments, the neck defines a wick opening into the fuel reservoir, a threaded fitting on an exterior top portion thereof, and an upright wall below the threaded fitting whereupon the flame guard is affixed. The flame guard may have a frustoconical cover extending radially downward from the neck and a collar in a center of the frustoconical cover that affixes the flame guard to the upright wall of the neck. The top of the fuel reservoir may be frustoconical and may have a steeper downward angle than and downward angle of the cover of the flame guard. The collar of the flame guard may be plastically deformed to grip the upright wall of the neck.

A wick may be retained in the wick holder in an operational position with wherein the wick has a length that extends from a location above the wick holder sufficient to allow burning or liquid fuel from the wick to the floor of the fuel reservoir. In such case a quantity of torch fuel is present within the fuel reservoir and a cap affixes to the threaded connection of the neck sealing the neck against fuel leaks without moving the wick from the operational position.

The invention of the present disclosure, in another aspect thereof, comprises a torch canister including a fuel reservoir having a frustoconical top with a neck defining an inner wick holder and an outer threaded fitting. A flame guard has a frustoconical cover extending radially away and downward from the neck beyond the fuel reservoir and terminating in a support rim. The neck extends through the cover and the cover and top are spaced apart.

In some cases the torch canister further comprises a cap that fits onto the neck in such a manner as to seal the neck against fuel leaks while a wick remains at a position in the neck where it is exposed to allow operation of the wick to burn liquid fuel while the wick extends to a bottom floor of the fuel reservoir. The flame guard may provide a collar at a center of the frustoconical cover, the collar joining to the neck. The collar may join to the neck such that the fuel reservoir is suspended from the flame guard when the flame guard is supported at the support rim by a torch body.

DETAILED DESCRIPTION OF THE PREFERRED EMBODIMENTS

Figure 1:
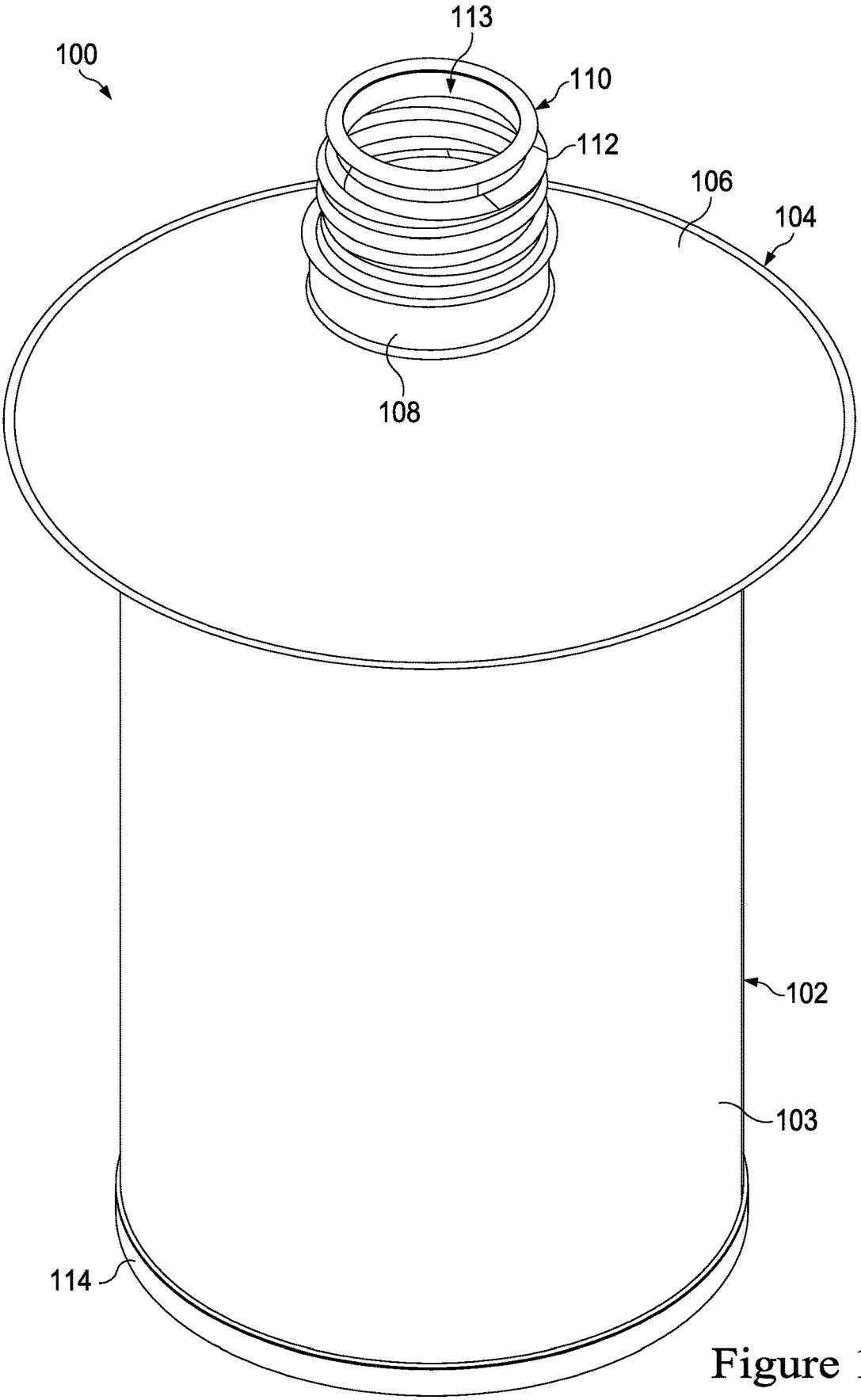
FIG. 1 is a perspective view of a ready to light torch canister with flame guard according to aspects of the present disclosure.

Referring now to FIG. 1, a perspective view of a ready to light torch canister with flame guard according to aspects of the present disclosure is shown. The canister 100 may comprise a fuel reservoir 102 that may be formed of a cylindrical wall 103 joined to a floor by a roll seam 114 or other connection. Affixed to the canister 100 is a shroud or flame guard 104. A neck 110 comprising part of the fuel reservoir 102 (or extending therefrom) may provide an attachment location for the flame guard 104.

The flame guard 104 may comprise a cover 106 extending over a top of the fuel reservoir 102. The cover 106 of the flame guard 104 may be circular or frustoconical and may be wider than a diameter of the fuel reservoir 102 to extend beyond the wall 103 such that the flame guard 104 may be used to suspend the fuel canister within a torch or container as discussed further below. The flame guard 104 may comprise collar 108, possibly centered in the cover 106. The collar 108 may be attached to the neck 110 of the fuel reservoir 102. The collar 108 may have an interference fit to the neck 110 or it may be welded, spot welded, glued, and/or affixed by one or more fasteners. In some embodiments, the collar 108 may be bent, pinched, or otherwise plastically deformed to grip the neck 110 once installed.

The neck 110 may provide a port 113, which may function as a filling or refilling port and may also function as a wick holder. A threaded fitting 112 is provided on the neck 110 allowing selective attachment of a cap.

Figure 2:
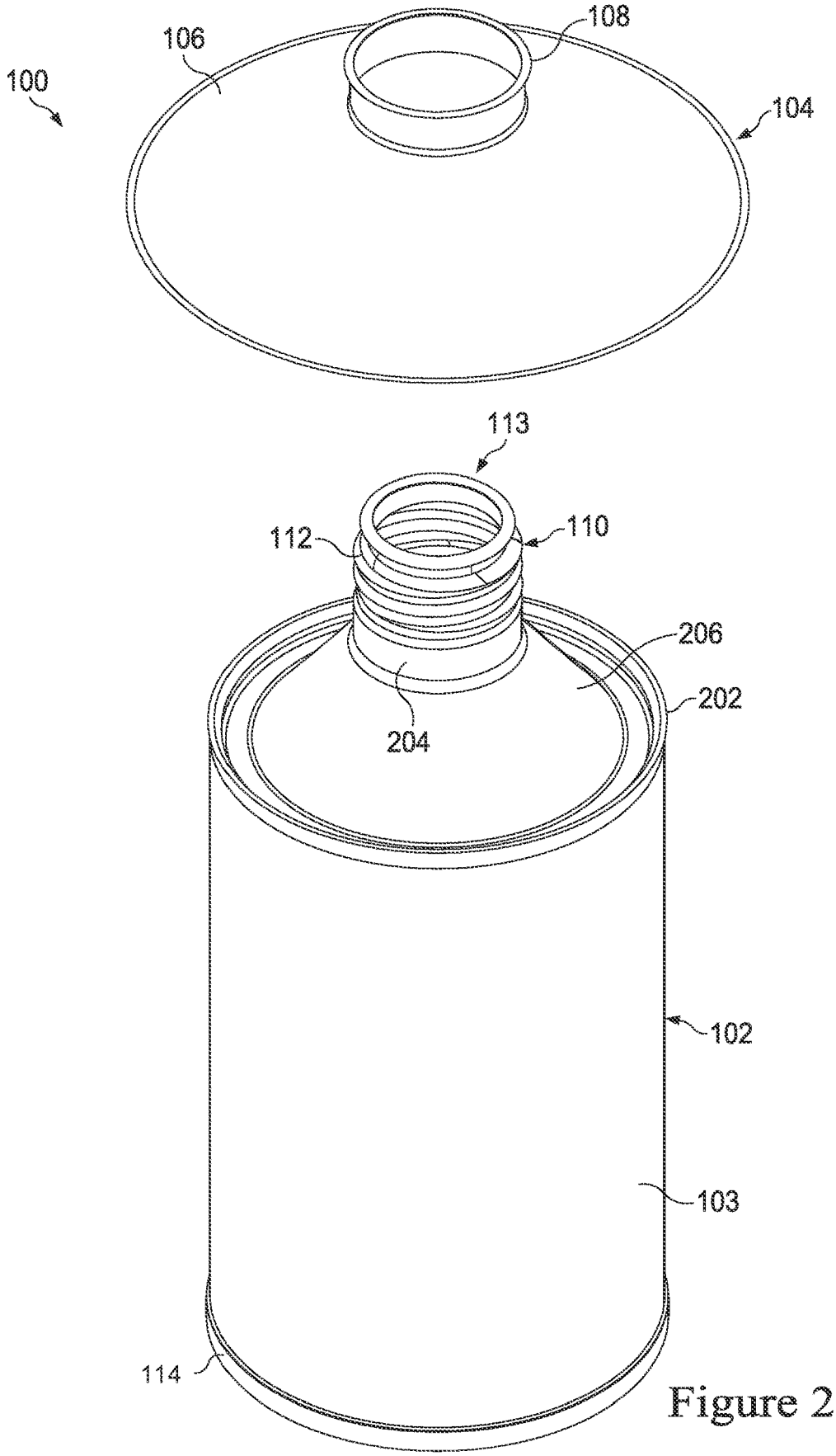
FIG. 2 is a partially exploded view of the torch canister of FIG. 1.

Referring now to FIG. 2 a partially exploded view of the torch canister 100 of FIG. 1 is shown. The flame guard 104 is shown removed from the fuel reservoir 102. A top 206 of the fuel reservoir 102 may join the wall 103 at a roll seam 202 or other attachment or joint. The top 206 of the fuel reservoir 102 may have a conic or frustoconical shape and may elevate the neck 110 away from the fuel reservoir 102.

In some embodiment, the neck 110 provides an upright wall portion 204 below the threaded fitting 112 where the collar 108 of the flame guard 104 attaches. The wall portion 204 is described as upright but it need not be perfectly vertical so long as a reliable attachment point is provided for the collar 108. The upright wall portion 204 may be devoid of threads or other impediments to a secure fitting location for the collar 108, which may not be intended to be removable once installed.

Figure 3:
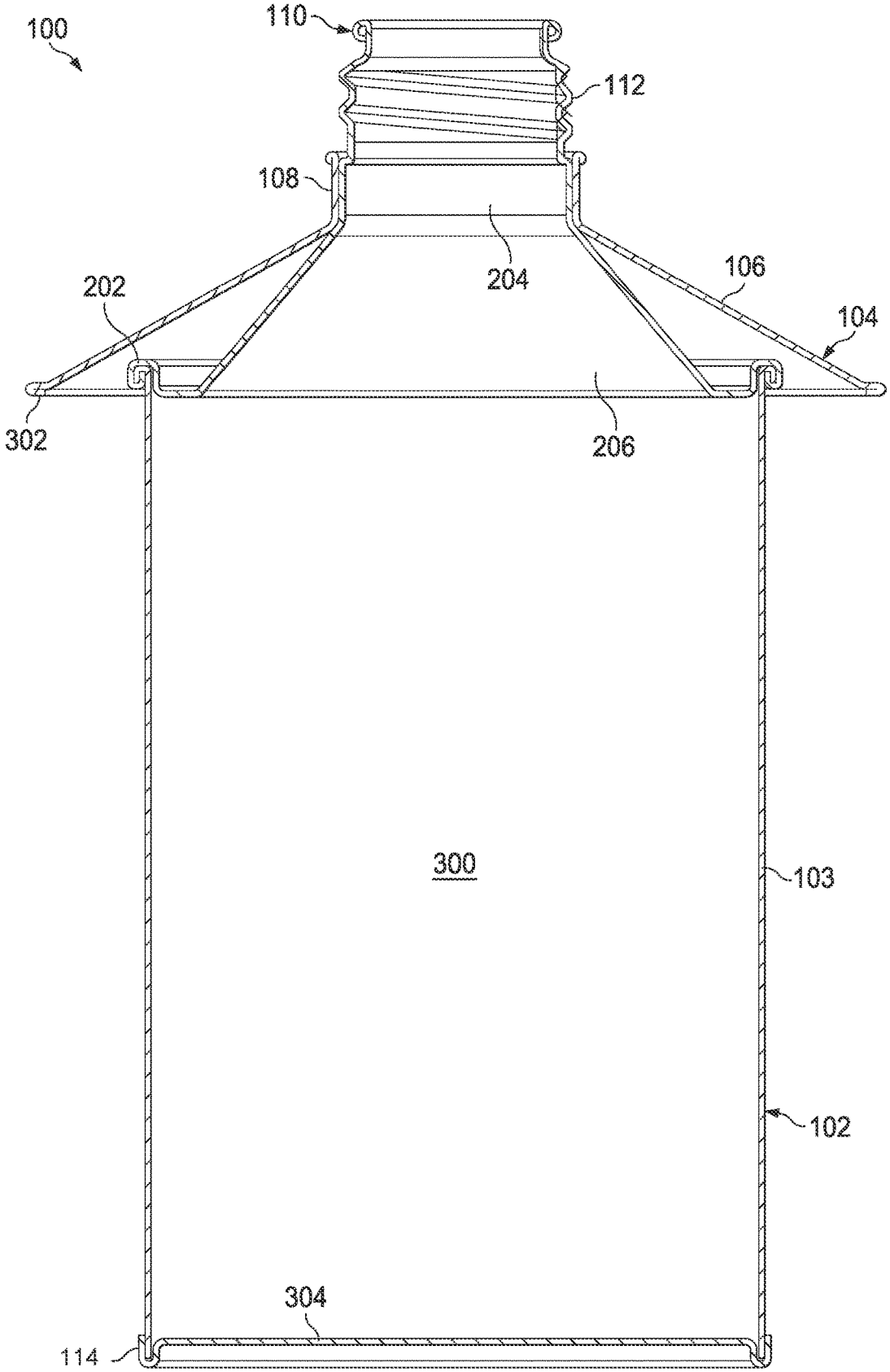
FIG. 3 is a side cutaway view of the torch canister of FIG. 1.

Referring now to FIG. 3 a side cutaway view of the torch canister 100 of FIG. 1 is shown. Here it can be seen that both the cover 106 of the flame guard 102 and the top 206 of the fuel reservoir 102 may have a conic or frustoconical shape. The angle of the top 206 in and below the cover 106 may be steeper than that of the cover 106 such that the cover 106 does not contact the top 206 and joins to the fuel reservoir 102 only at the neck 110. The cover 106 may extend past the wall 103 and possible to or below the vertical level of the roll seam 202 or top of the wall 103. A portion of the cover 106 extending beyond the wall 103 may provide a ledge or rim 302 for suspending the torch canister 100 within a torch body.

The fuel reservoir 102 may have a floor 304 that may join the wall 103 at roll seam 114. The wall 102, and the floor 304 may define an interior volume 300 for storage of liquid torch fuels as are known in the art. In some embodiments, the top 206 may also define or partially define the interior volume 300, depending upon the amount of fuel contained in the reservoir 102.

In some embodiments, the components and subcomponents of the canister 100 including the fuel reservoir 102 and its wall 103, floor 304, top 206, and neck 110 may be formed of a metal or alloy such as rolled steel, polymers, and/or other suitable materials. The subcomponents such as the floor 304, wall 103, and top 206 may be rolled seamed together as shown, but they can also be welded, glued, or attached by other means known in the art to create a reliable connection for retaining liquid fuel. Paints, sealants, and heat resistance coatings as known in the art may be applied. The flame guard 104 may also be formed of a polymer, a metal, or metal alloy such as rolled steel. The fuel reservoir 102 and the flame guard 104 are illustrated as components that are circular or round in horizontal cross section. However, they could also be constructed of rectangular, squared, or rectilinear components where appropriate.

Figure 4:
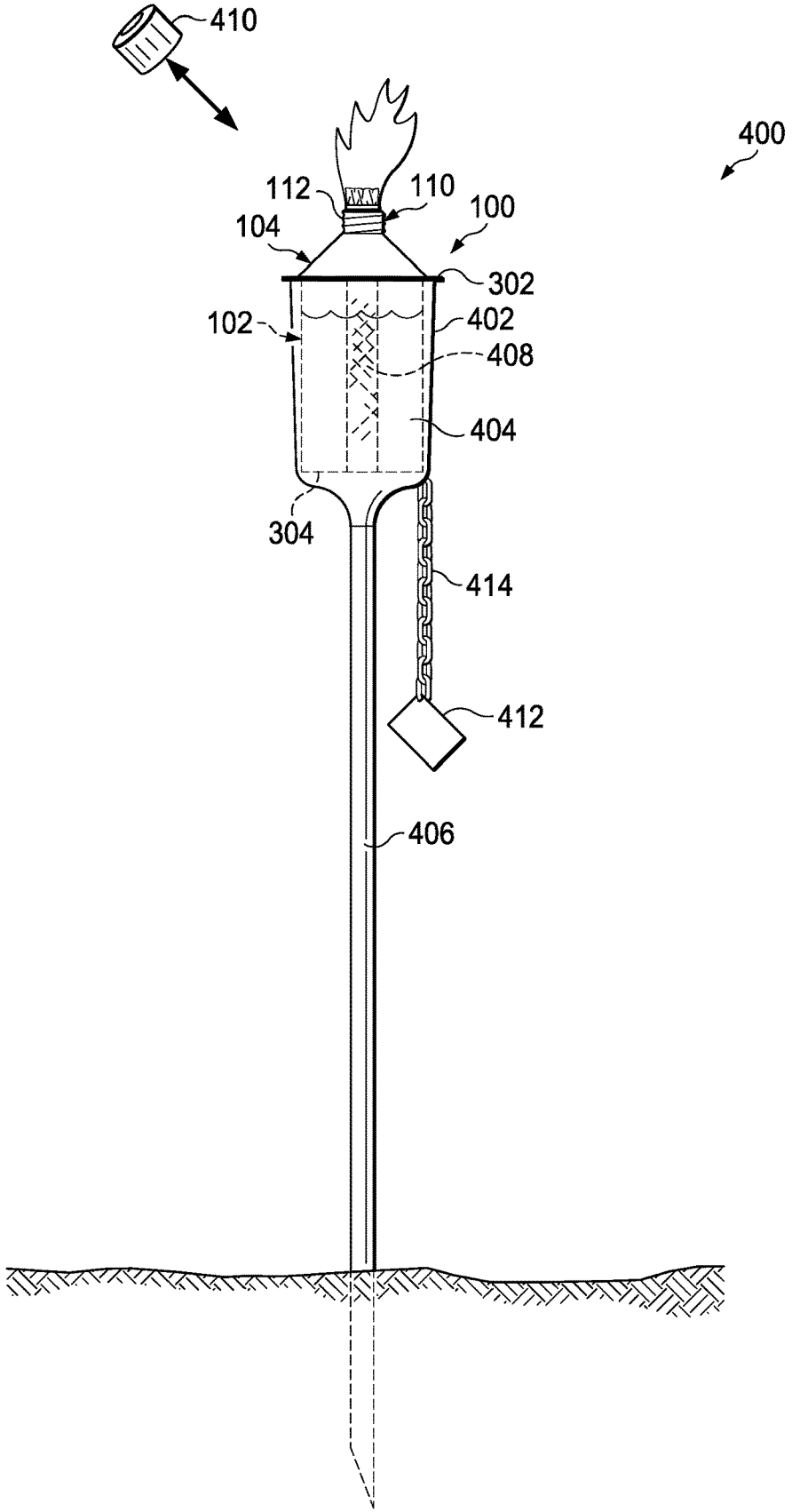
FIG. 4 is a side cutaway view of the torch canister of FIG. 1 installed in an operational lawn torch.

Referring now to FIG. 4, a side cutaway view of the torch canister 100 of FIG. 1 installed in an operational lawn torch 400 is shown. The lawn torch 400 is only exemplary and embodiments of the torch canister 100 may find application beyond this example. Here the lawn torch 400 comprises a pole 406 inserted into ground surface. Atop the pole 406 is a receptacle 402. The torch canister 100 may provide fuel 404, a wick 408, flame guard 104 and other needed components in a ready to use, ready to light, package.

The fuel reservoir 102 may be sized for direct insertion into the receptacle 402 such that the fuel reservoir 102 is suspended within the receptacle 402. The rim 302 may rest atop the receptable 402 and cover all or part of an opening thereof into which the fuel reservoir 102 is inserted. The flame guard 104 is thereby positioned outside and at the highest point on the torch 400 for operation.

The fuel reservoir 102 may be provided with a cap 410 that fits to the threads 112 to prevent leakage or spillage of fuel 404 during transit or when not otherwise in use. The neck 110 and/or wick holder (113, FIG. 2), the top 206, as well as the flame guard 104 and fuel reservoir 102, may be sized such that the wick 408 is sufficiently exposed for proper operation as soon as the cap 410 is removed. The wick 408, fuel reservoir 102, neck 110, and the flame guard 104, may be sized such that the wick 408 extends all the way to the floor 304 of the fuel reservoir 102 minimizing unburnable fuel within the fuel reservoir 102.

The torch 400 may also provide a snuffer 412 on a tether 414. The cap 410 may be replaced on the neck 110 after snuffing to prevent fuel loss or spillage when the torch 400 is not in operation.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A torch canister comprising:

a fuel reservoir having a side wall, a floor, and a top defining an interior volume for containing fuel;

a neck extending from the top of the fuel reservoir and defining a wick holder; and a flame guard affixed to the neck of the fuel reservoir and extending over the top and laterally beyond the side wall;

wherein the neck defines a threaded connection on an exterior thereof and a non-threaded upright wall portion below the threaded connection that joins to the flame guard;

wherein the flame guard provides a cover that extends over the top and laterally beyond the side wall, and a collar centered in the cover that joins to the neck; and wherein the collar of the flame guard is plastically deformed to grip the upright wall portion.

2. The torch canister of claim 1, wherein the top of the fuel reservoir is frustoconical and elevates the neck above the fuel reservoir.

3. The torch canister of claim 2, wherein the cover is frustoconical and extends downward and away from the neck.

4. The torch canister of claim 3, wherein the cover and the top of the fuel reservoir are spaced apart.

5. The torch canister of claim 4, further comprising a wick retained in the wick holder and having a length that extends from a location above the wick holder sufficient to allow burning of liquid fuel from the wick to the floor of the fuel reservoir.

6. The fuel container of claim 5, further comprising a quantity of torch fuel within the fuel reservoir and a cap affixed to the threaded connection of the neck sealing the neck against fuel leaks without moving the wick.

7. The fuel container of claim 6, wherein the top of the fuel reservoir and the floor of the fuel reservoir are both roll seamed to the side wall.

8. A torch canister comprising:

a cylindrical fuel reservoir having a top extending upwardly therefrom to a neck; and a flame guard affixed to the neck and extending radially and downward therefrom beyond the fuel reservoir but spaced apart from the fuel reservoir top wherein the neck defines:

a wick opening into the fuel reservoir;

a threaded fitting on an exterior top portion thereof; and a non-threaded upright wall below the threaded fitting whereupon the flame guard is affixed; and wherein the flame guard has a frustoconical cover extending radially downward from the neck and a collar in a center of the frustoconical cover that affixes the flame guard to the upright wall of the neck.

9. The torch canister of claim 8, wherein the top of the fuel reservoir is frustoconical and has a steeper downward angle than a downward angle of the cover of the flame guard.

10. The torch canister of claim 9, wherein the collar of the flame guard is plastically deformed to grip the upright wall of the neck.

11. The torch canister of claim 10 further comprising:

a wick retained in the wick holder in an operational position wherein the wick has a length that extends from a location above the wick holder sufficient to allow burning of liquid fuel from the wick to the floor of the fuel reservoir; and a quantity of torch fuel within the fuel reservoir and a cap affixed to the threaded connection of the neck sealing the neck against fuel leaks without moving the wick from the operational position.

12. A torch canister comprising:

a fuel reservoir having a frustoconical top with a neck defining an inner wick holder, an outer threaded fitting, and an outer non-threaded upright wall below the outer threaded fitting; and a flame guard having a frustoconical cover affixed to the non-threaded upright wall extending radially away and downward from the neck beyond the fuel reservoir and terminating in a support rim;

wherein the neck extends through the cover; and wherein the cover and top are spaced apart.

13. The torch of claim 12, further comprising a cap that fits onto the neck in such a manner as to seal the neck against fuel leaks while a wick remains at a position in the neck where it is exposed to allow operation of the wick to burn liquid fuel while the wick extends to a bottom floor of the fuel reservoir.

14. The torch canister of claim 13, wherein flame guard provides a collar at a center of the frustoconical cover, the collar joining to the neck.

15. The torch canister of claim 14, wherein the collar joins to the neck such that the fuel reservoir is suspended from the flame guard when the flame guard is supported at the support rim by a torch body.

* * * * *